US005099828A

United States Patent [19]

Duke

[11] Patent Number: 5,099,828

[45] Date of Patent: Mar. 31, 1992

[54] PASSIVE EXERCISE APPARATUS FOR ENTIRE BODY

[76] Inventor: Carl H. Duke, #5 Rip Van Winkle, Houston, Tex. 77024

[21] Appl. No.: 374,272

[22] Filed: Jun. 30, 1989

[51] Int. Cl.[5] ..... A61H 1/00

[52] U.S. Cl. ..... 128/25 R

[58] Field of Search ..... 128/25 R, 69, 70, 72, 128/73, 33, 80 R, 80 F, 86, 87 R, 25 B; 269/322, 323, 324, 328

[56] References Cited

U.S. PATENT DOCUMENTS

| | | | |
|---|---|---|---|
| 1,482,173 | 1/1924 | Willard | 128/70 |
| 2,886,028 | 5/1959 | Vogtmann et al. | 128/25 R |
| 2,893,380 | 7/1959 | Walker et al. | 128/25 R |
| 3,895,623 | 7/1975 | Mahlandt et al. | 128/25 R |
| 4,059,255 | 11/1977 | Perold | 269/323 |
| 4,372,551 | 2/1983 | Yurdin | 269/322 X |
| 4,480,830 | 11/1984 | Petrofsky et al. | 272/125 X |
| 4,526,355 | 7/1985 | Moore et al. | 269/328 |
| 4,587,961 | 5/1986 | Ventura et al. | 128/25 R |
| 4,776,587 | 10/1988 | Cartson et al. | 128/25 R |
| 4,834,072 | 5/1989 | Goodman | 128/25 R |
| 4,834,073 | 5/1989 | Bledsoe et al. | 128/25 R X |

FOREIGN PATENT DOCUMENTS

| | | | |
|---|---|---|---|
| 410274 | 10/1966 | Switzerland | 128/33 |

*Primary Examiner*—Richard J. Apley
*Assistant Examiner*—Linda C. M. Dvorak
*Attorney, Agent, or Firm*—Gunn, Lee & Miller

[57] ABSTRACT

A repetitive motion apparatus is disclosed for exercising a patient's entire body and stimulating the cardiovascular system. The apparatus comprises a stationary outer frame having a movable inner frame pivotally mounted thereon. The apparatus includes stimulator mechanisms for the arms, shoulders, hips and legs of the patient. The inner frame of the apparatus may be raised or lowered between a minimum and maximum angle for enhancing the benefit of passive exercise by the patient.

14 Claims, 8 Drawing Sheets

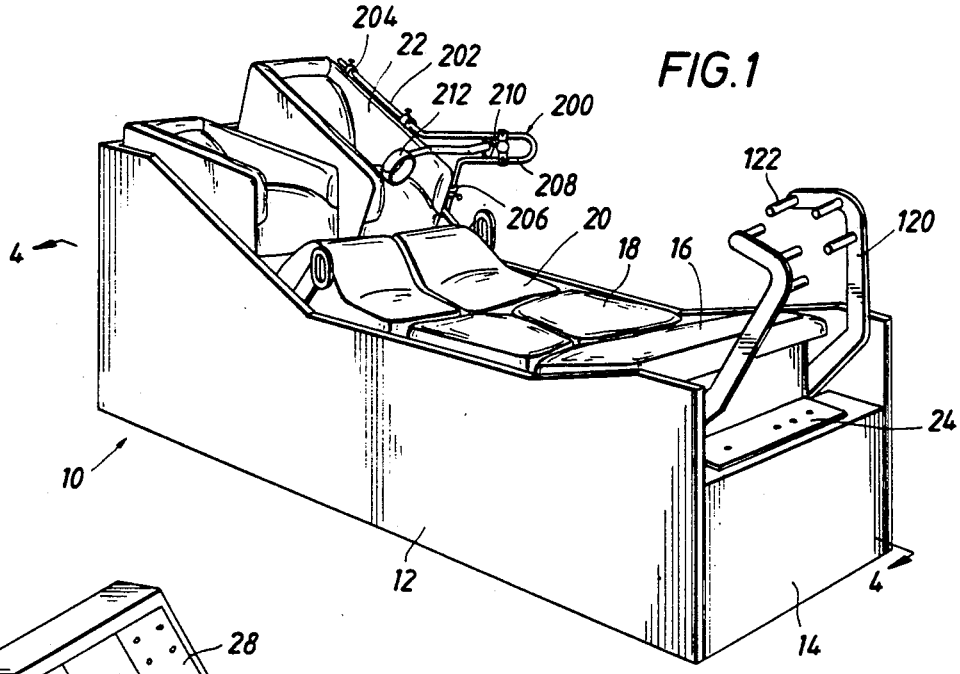
FIG. 1
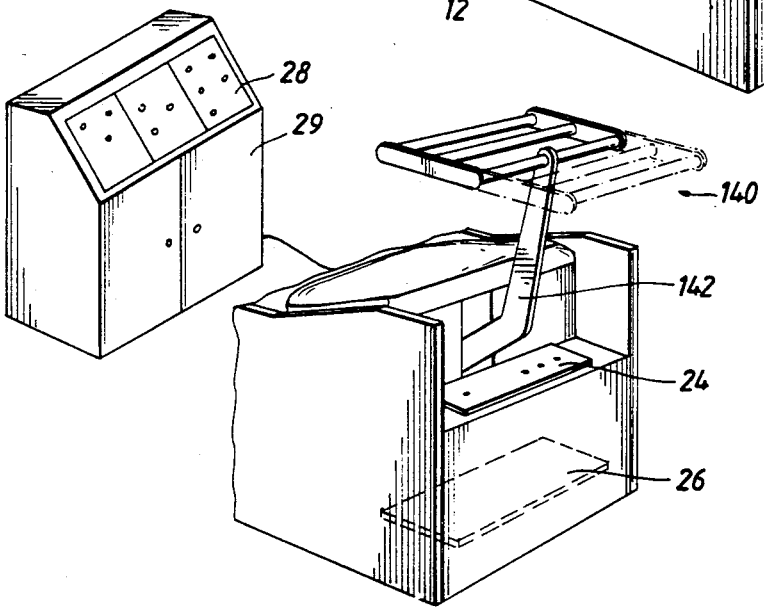
FIG. 2
FIG. 3
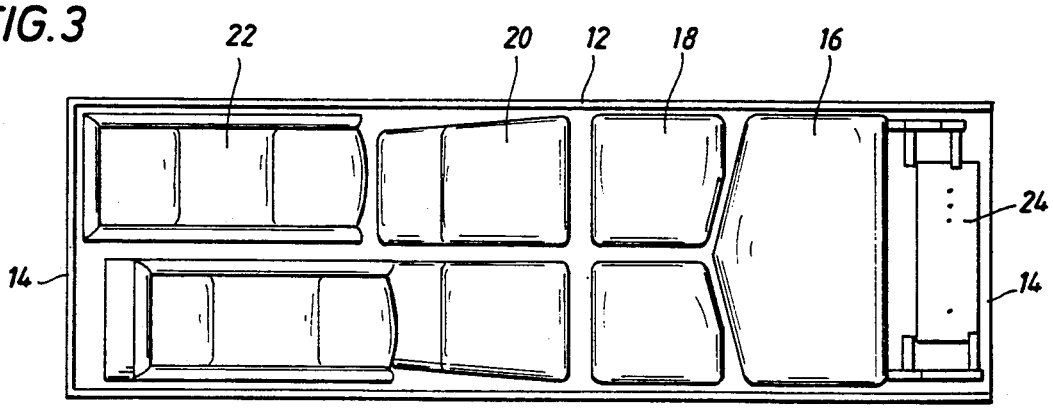

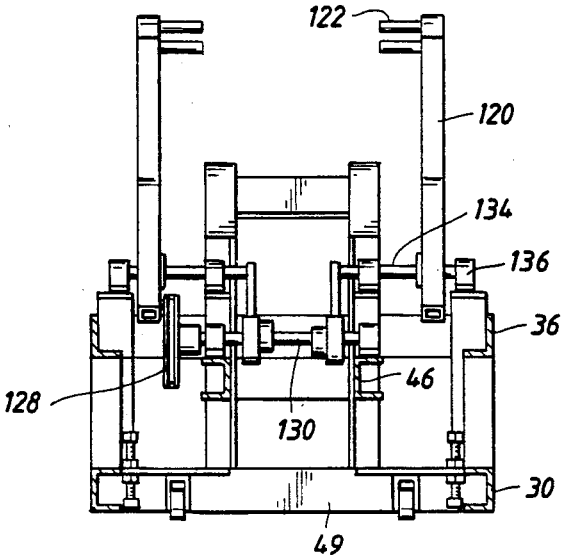
FIG. 11
FIG. 12
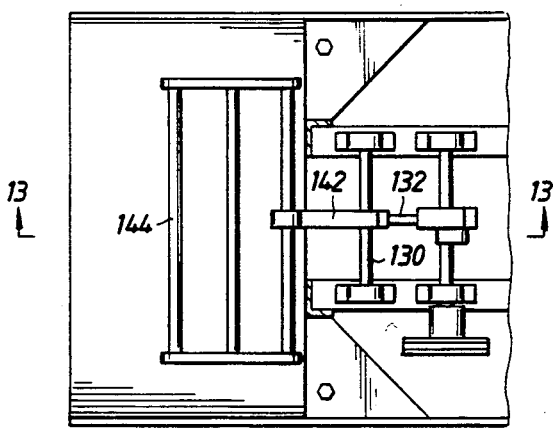
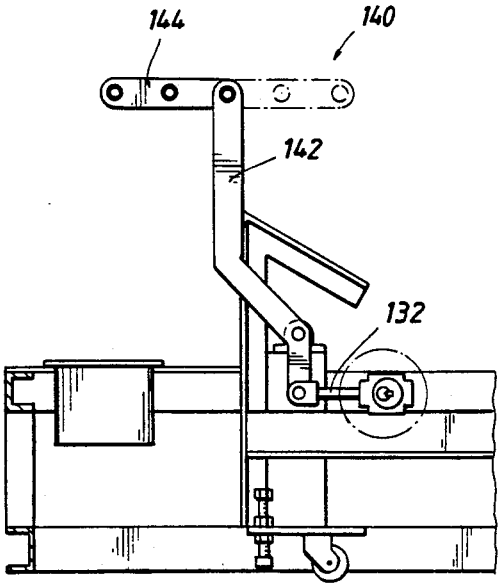
FIG. 13

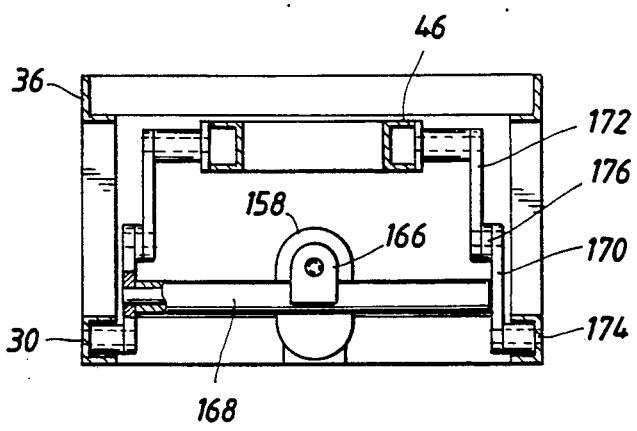
FIG. 16
FIG. 17
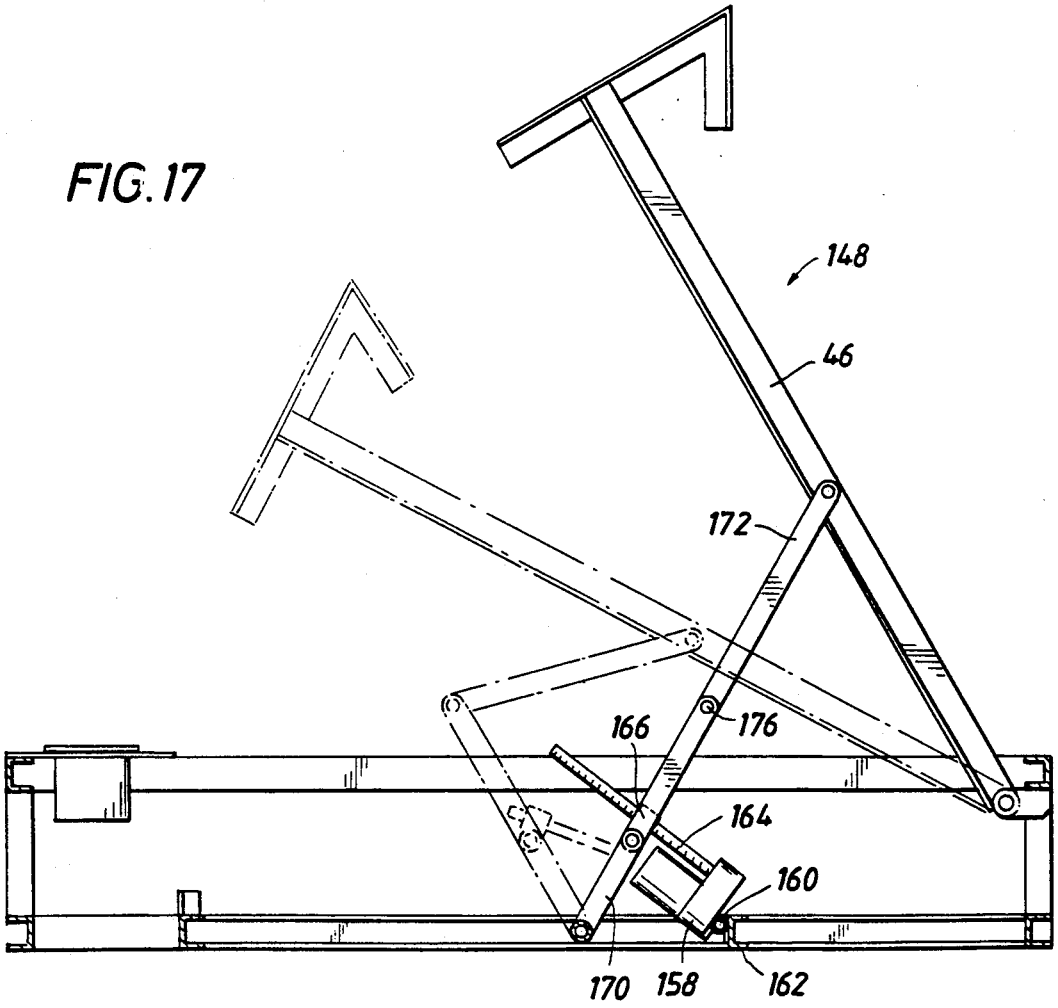

FIG. 19
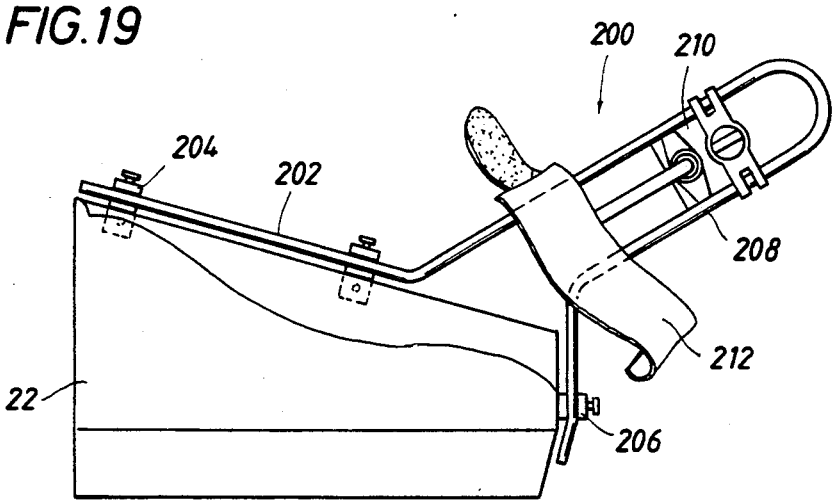
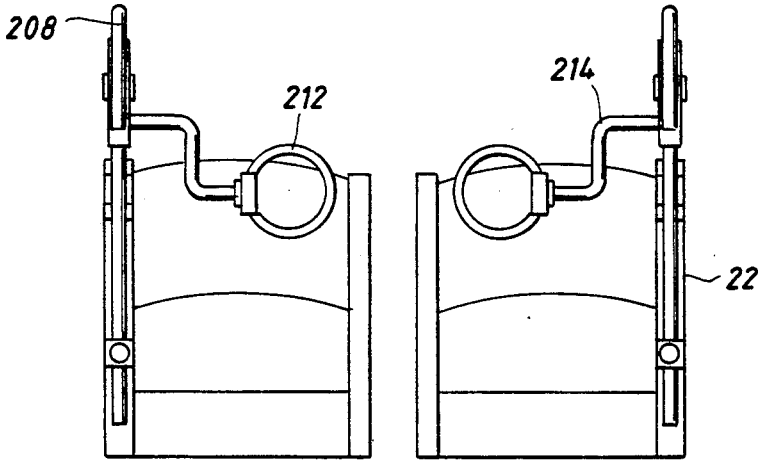
FIG. 20
FIG. 18
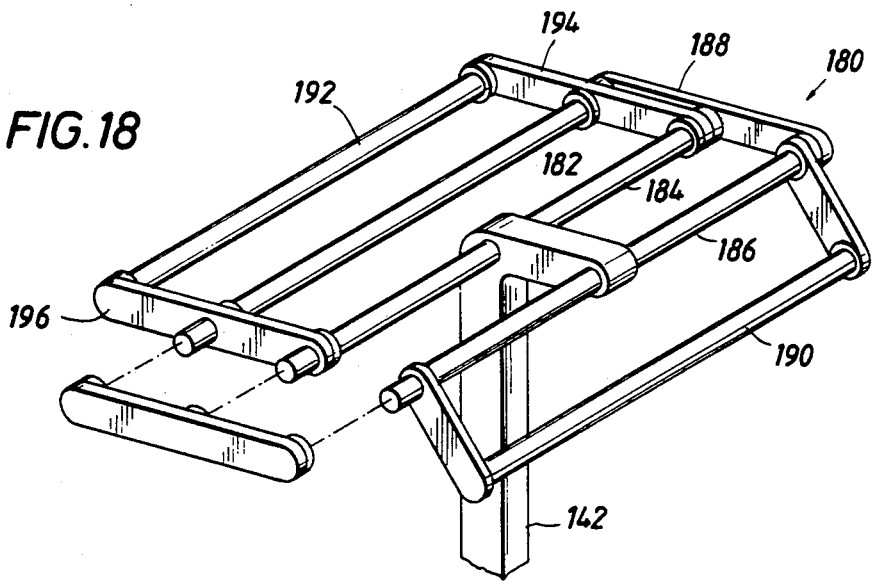

PASSIVE EXERCISE APPARATUS FOR ENTIRE BODY

BACKGROUND OF THE DISCLOSURE

This invention relates to a repetitive motion apparatus, particularly, a passive exercise apparatus for exercising the entire body and providing cardiovascular stimulation and conditioning.

In recent years, the need for health care and overall body conditioning has been raised in the consciousness of the general population. Renewed interest has been sparked in taking care of the body. The number of exercise clubs has mushroomed and a multitude of fitness programs are available to the consumer. But very little has been provided for those not able to engage in strenuous exercise. Those individuals who suffer from arthritis, heart problems, high blood pressure and obesity related health problems are not able to participate in strenuous exercise or operate most exercise equipment which is currently available.

Walker, et al., in U.S. Pat. No. 2,893,380, discloses a massage and exercise machine including a mechanism for manipulating the hips and shoulders of a patient, a mechanism for moving the legs of the patient in various manners and a mechanism for stretching the arms of the patient to various degrees. The hips and shoulder mechanism moves in various orbits in a horizontal plane for manipulating the hips and shoulders of a patient lying in a horizontal position on the exercise machine. While lying in the horizontal position, the patient may place his legs and feet upon the leg pads of the leg action mechanism. The leg pads move opposed to one another so that the motion of the legs can simulate a bicycle exercise or a straight knee-bend exercise. The arm stretch mechanism of the machine is positioned behind the head rest and comprises reciprocating spaced hand bars which are gripped by the hands of the patient to obtain various degrees of backward arm stretch.

Tietsworth, U.S. Pat. No. 4,628,909, discloses a health care machine for exercising a patient's arms and legs in which one arm and an opposite leg are alternatively raised and lowered. Synchronized exercising is provided wherein one of the arms is bent at the elbow and an opposite leg is bent at the knee by being alternatively raised and lowered.

Kessler, U.S. Pat. No. 4,612,917, discloses a passive exercise machine including a head pad, two shoulder pads, two buttock pads and two foot pads which move relative to each other in predetermined ways. The two hip pads, working together, provide a repetitive squeezing and loosening action against the patient's hips. An adjustable reciprocating arm over the head pad is also provided.

Kennard, et al., U.S. Pat. No. 2.949,911 discloses a body exercising table including a movable table top mounted on a base. The table top comprises two parts which are secured together for simultaneous oscillatory movement. A pair of independently moving platforms are mounted between the two movable parts of the table top. A foot and hand bar assembly is mounted on the top of the table top adjacent one end of the supporting frame. Operation of the exercise table is controlled by an electronic sequence timer which is mounted on the table base.

The benefits of passive exercise have been known for quite sometime, however, prior art apparatus are limited in their ability to provide strenuous exercise for the entire body and fail to provide complete cardiovascular stimulation. The exercise apparatus of the present disclosure overcomes the disadvantages of available apparatus.

SUMMARY OF THE INVENTION

In accordance with this invention, a repetitive motion exercise apparatus is disclosed for providing complete cardiovascular stimulation. The apparatus comprises a substantially rectangular frame supporting various mechanisms for stimulating the parts of the body. The stimulation mechanisms may be computer controlled and stimulate the body in a predetermined sequence and for a predetermined duration as required by the patient. The patient reclines on the padded surface of the apparatus while the arms, legs, hips and shoulders of the patient are stimulated. The apparatus also includes a movable subframe which may be inclined to provide additional cardiovascular stimulation.

BRIEF DESCRIPTION OF THE DRAWINGS

So that the manner in which the above recited features advantages and objects of the present invention are attained and can be understood in detail, a more particular description of the invention, briefly summarized above, may be had by reference to the embodiments thereof which are illustrated in the appended drawings It is to be noted, however, that the appended drawings illustrate only typical embodiments of this invention and are therefore not to be considered limiting of its scope, for the invention may admit to other equally effective embodiments.

FIG. 1 is a perspective view of the apparatus of the invention;

FIG. 2 is a partial perspective view of the apparatus showing a remote control panel connected thereto;

FIG. 3 is a top plan view of the apparatus of FIG. 1;

FIG. 11 is a sectional view taken along line 11—11 of FIG. 4;

FIG. 12 is a partially broken away, top plan view of an alternate embodiment of the arm stimulator mechanism of the invention;

FIG. 13 is a partial, sectional view taken along line 13—13 of FIG. 12;

FIG. 16 is a sectional view taken along line 16—16 of FIG. 15;

FIG. 17 is a partial side view showing the subframe of the alternate embodiment of the invention at an inclined position;

FIG. 18 is a partial, exploded view of an extendable arm bar of the invention;

FIG. 19 is a partial side view of a leg brace mountable on the leg support of the invention; and FIG. 20 is an end view of the leg braces of the invention.

DETAILED DESCRIPTION OF THE PREFERRED EMBODIMENT

Figure 4:
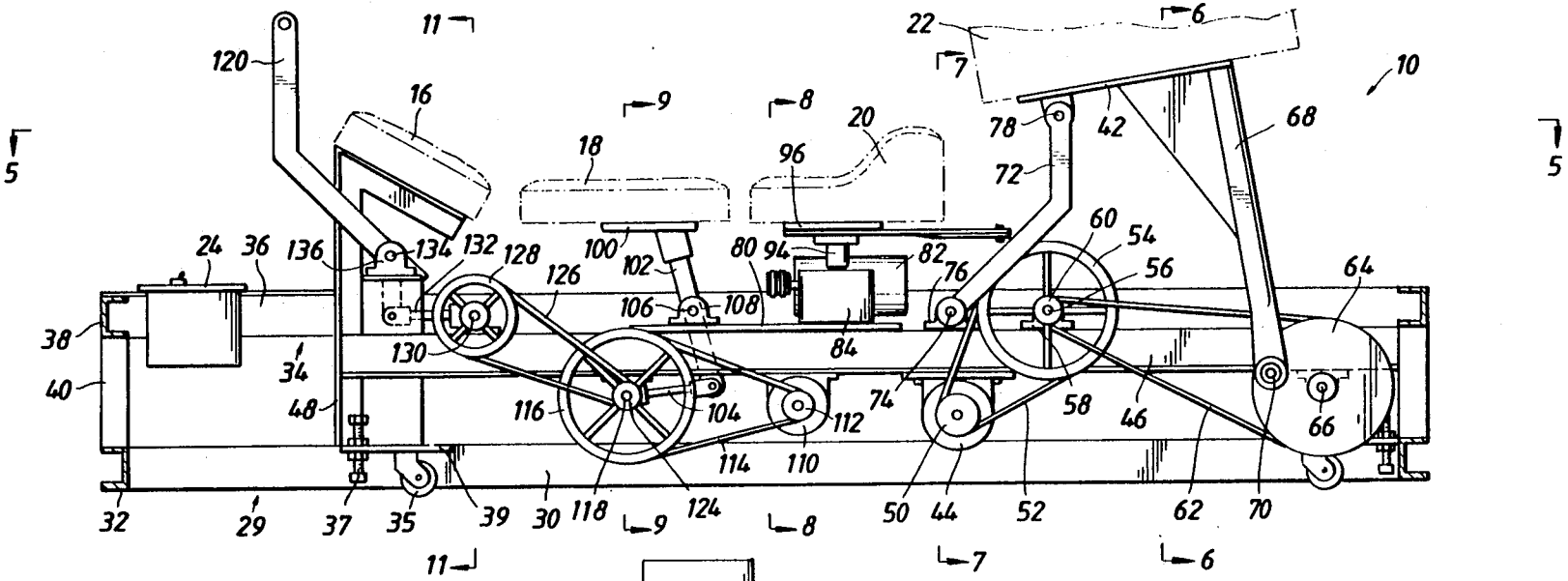
FIG. 4 is a partially broken away side view taken along line 4—4 of FIG. 1.

Referring first to FIG. 1, the exercise apparatus of the invention is generally identified by the reference numeral 10. It will be observed that the apparatus 10 comprises a substantially rectangular frame enclosed by side boards 12 and end boards 14. The side boards and end boards 12 and 14 are padded with a protective material so that a patient may avoid the risk of injury getting on and off the apparatus 10. Also supported on the frame of the apparatus 10 is a padded head rest 16, shoulder pads 18, hip pads 20 and leg supports 22 which are sufficiently cushioned to protect the patient.

A control panel 24 is located at the head rest end of the apparatus 10. The control panel 24 is mounted in a recess defined between the side boards 12 and the end boards 14. The control panel 24, shown in FIG. 1, is connected to a circuit board 26 supported on the interior frame of the apparatus 10.

A remote control panel 28, shown in FIG. 2, is connected to the apparatus 10. The remote control panel is housed within a cabinet 29 supported on casters or the like for mobility. Alternatively, the remote control panel may be wall mounted. The remote control panel, whether movable or wall mounted, is particularly useful in a hospital environment enabling multiple apparatus 10 to be connected to the remote control panel 28 and operated therefrom. The apparatus 10 may be equipped with various sensing devices for monitoring heart rate, blood pressure, or the like. The sensing devices are connected to the control panel 24 or the remote control panel 28 for monitoring the condition of the patient during an exercise program. Additionally, the control panels 24 and 28 may include a printing mechanism for printing selected data. The apparatus 10 may also be equipped with alarm devices which emit an audio and/or video signal in the event a patient's vital signs exceed or fall below a preset level.

Referring now to FIG. 4, the interior frame of the apparatus 10 is shown in greater detail. The frame of the apparatus 10 comprises a lower rectangular frame 29 formed by two longitudinally extending channel members 30. Cross members 32 connect the ends of the channel members 30 to form a substantially rectangular unitary frame. An upper frame 34 is spaced above and connected to the lower frame 29. The upper frame 34 is formed by two longitudinally extending angle iron members 36 which are connected at the ends thereof by cross members 38. Vertical members 40 support the upper frame 34 on the lower frame 29. The vertical members 40 are welded between the upper and lower frames 34 and 29 thereby forming a substantially rectangular, box-like frame for supporting the motion imparting components of the repetitive motion apparatus.

The apparatus 10 is supported on casters 35 which are mounted to the lower frame 29. The casters 35 permit the apparatus 10 to be easily moved and relocated as required. When positioned for use, the frame of the apparatus 10 is supported on adjustable threaded legs 37. The legs 37 are threaded through the caster support plates 39 and engage the floor and lift the casters 35 off of the floor. The full weight of the apparatus 10 is thus supported on the legs 37 so that the apparatus 10 is stationary while it is in use.

The legs and feet of a patient are supported by cushioned foot rests 22 which are mounted on leg support plates 42. The leg support plates 42 are driven by a motor 44 mounted below interior channel members 46. The motor 44 is bolted or otherwise secured to the lower surface of the channel members 46, as best shown in FIG. 4. The channel members 46 form the interior frame support of the apparatus 10. The channel members 46 are mounted interiorly of the upper and lower frames 29 and 34 and are welded or otherwise secured at one end thereof to the cross member 38. At the opposite end, the channel members 46 are welded to a pair of spaced supports 48 which are mounted to a cross member 49 (best shown in FIG. 11) welded between the channel members 30 of the lower frame 29.

Figure 6:
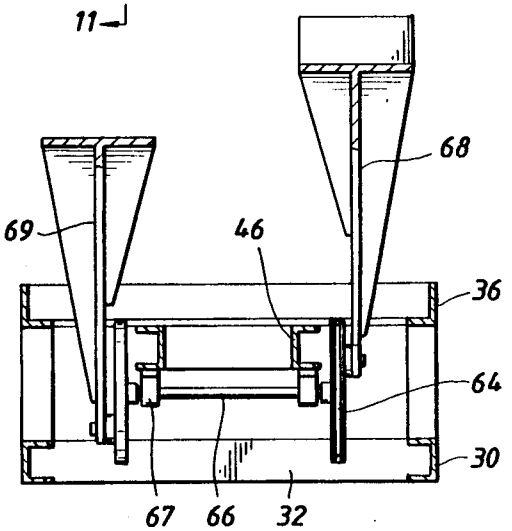
FIG. 6 is a sectional view taken along line 6—6 of FIG. 4.

The motor 44 includes a pulley 50 for receiving a belt 52 which passes around a pulley wheel 54 connected to a shaft 56. The shaft 56 is secured to the channel members 46 by bearings 58. The end of the shaft 56 extends outwardly beyond the pulley wheel 54 for receiving a pulley 60 thereon. The pulley 60 receives a belt 62 which passes around a pulley 64 connected to a shaft 66. As shown in FIG. 6, the shaft 66 spans the space between the channel members 46 for supporting the pulley 64 and a disk 65 which are journalled about the ends of the shaft 66. The shaft 66 is suspended below the channel members 46 by bearings 67.

A large leg support shaft 68 is pivotally connected to the pulley 64 at 70. Similarly, a leg support shaft 69 is pivotally connected to the disk 65. The leg support shaft 68 terminates at its upper end in an integrally formed support plate 42 which supports the leg support 22 thereon. A crank arm 72 is pivotally connected to the back surface of the support plate 42 and is pivotally connected at its opposite end to a shaft 74 mounted across the channel members 46. The shaft 74 is secured to the channel members 46 by bearings 76. The crank arm 72 is permitted to pivot freely about the pivot point 78 and the shaft 74. Upon actuation of the motor 44, the pulley wheel 54 is rotated which in turn rotates the pulley 64 and disk 65, thereby actuating the leg support shafts 68 and 69 so that the leg supports 22 are raised and lowered. Due to the linkage between the leg support shaft 68 and the crank arm 72, the leg support 22 is moved in a somewhat oscillatory fashion so that the patient's legs are raised and forced slightly toward the patient and moved through a somewhat circular or bicycle-like motion. The leg support shaft 69 is similarly actuated so that the patient's legs may be alternately raised and lowered. The patient's legs may also be raised and lowered together for exercising of the abdominal muscles.

Figure 5:
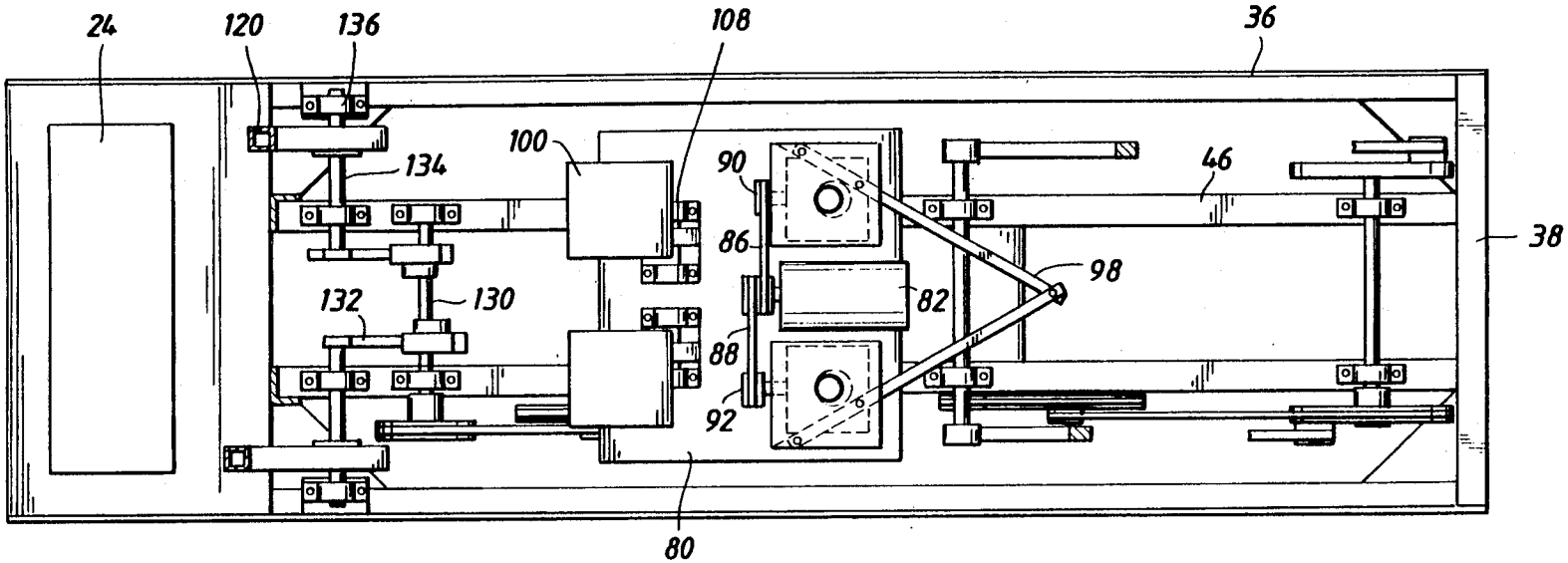
FIG. 5 is a partially sectional, top plan view taken along line 5—5 of FIG. 4.
Figure 7:
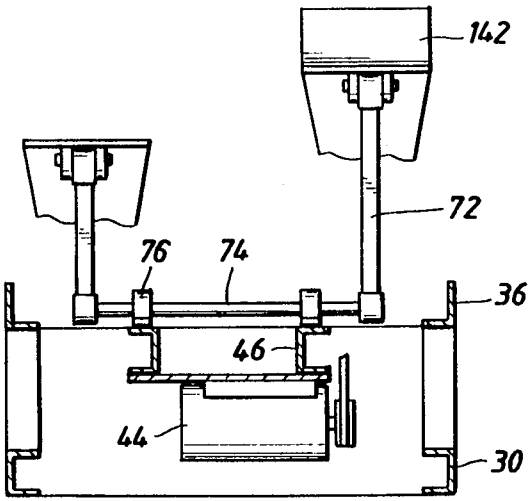
FIG. 7 is a sectional view taken along line 7—7 of FIG. 4.
Figure 8:
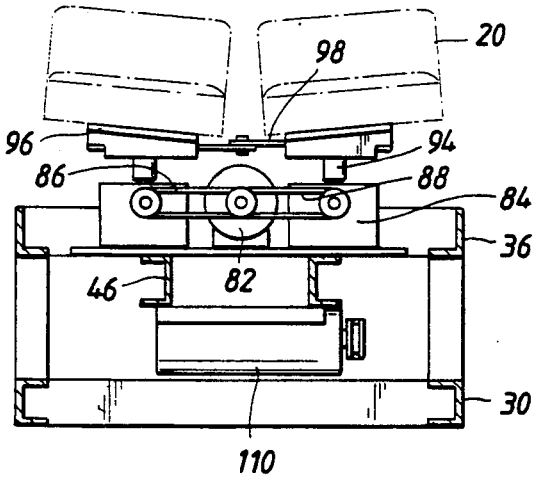
FIG. 8 is a sectional view taken along line 8—8 of FIG. 4.

Referring now to FIG. 5, the hip and shoulder stimulators are shown mounted to a plate 80. The plate 80 is supported on the channel members 46, as best shown in FIG. 4. The hip stimulators are driven by a motor 82 mounted on the plate 80 between the gear reduction units 84. The motor 82 includes a shaft supporting a pair of pulleys connected by belts 86 and 88 with pulleys 90 and 92 respectively. The pulleys 90 and 92 are mounted on shafts extending from the gear reduction units 84. The gear reduction units 84 include output shafts 94 which carry cam portions thereon as best shown in FIG. 5. The cam portions are rotated by the gear reduction units 84 at a desired speed and direction. A support plate 96, shown in FIG. 4, is mounted on the output shafts 94. The hip pads 20 are secured to the support plates 96 to complete the hip stimulator assembly. A connecting linkage 98 connects the support plates 96 of each of the hip stimulator units so that the hip pads 20 move synchronously upon actuation of the motor 82.

Figure 9:
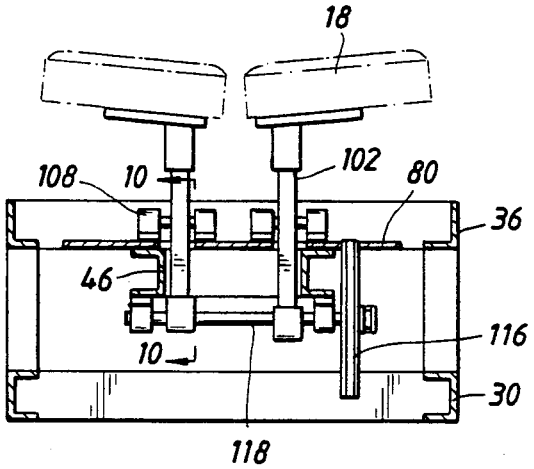
FIG. 9 is a sectional view taken along line 9—9 of FIG. 4.
Figure 10:
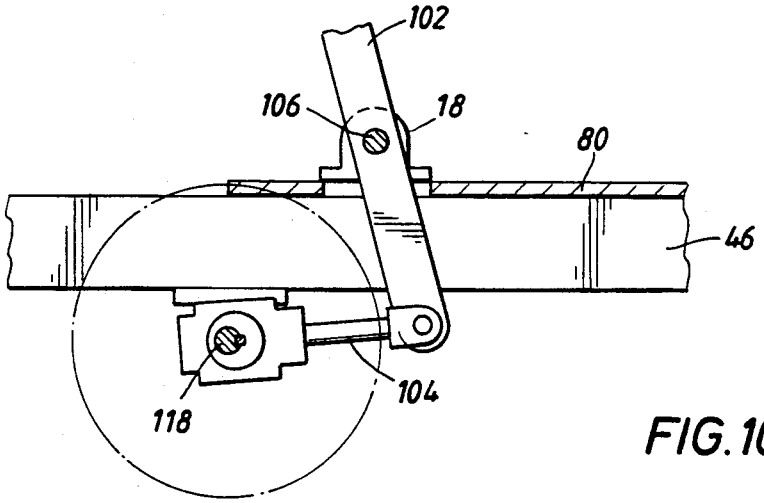
FIG. 10 is a partial sectional view taken along line 10—10 of FIG. 9.
Figure 14:
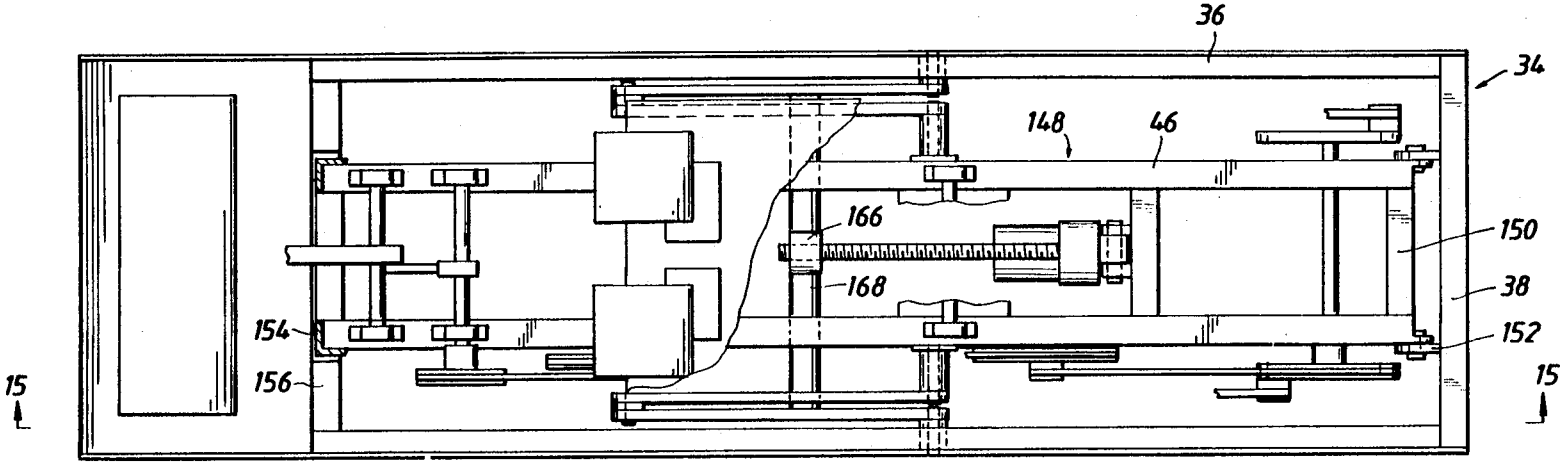
FIG. 14 is a partially broken away, top plan view of an alternate embodiment of the apparatus of the invention.

The shoulder stimulator assembly includes shoulder plates 100 which support the shoulder pads 18 thereon. A shaft 102 extends downwardly from each shoulder plate 100 through the plate 80 and is connected at its lower end to a crank arm 104. As best shown in FIG. 9, the shafts 102 pivot about a pair of support shafts 106 which are mounted on the plate 80. The support shafts 106 are mounted on the plate 80 by bearings 108.

The shoulder stimulator assembly is driven by motor 110 mounted below the channel members 46. The motor 110 includes a pulley 112 for receiving a pulley belt 114 which passes around a pulley wheel 116 connected to a shaft 118. The shaft 118 carries a cam portion which is rotated upon rotation of the shaft 118 which in turn imparts a reciprocating motion to the crank arm 104. Reciprocation of the crank arm 104 imparts a reciprocating back and forth motion to the shoulder stimulator assembly shaft 102.

The apparatus 10 includes an arm bar for exercising the arms and upper torso of a patient. In the embodiment shown in FIG. 1, the arm bar comprises two spaced arm handles 120 which project behind and above the head rest 16. The arm handles 120 have a plurality of handle bars 122 spaced thereon. The arm handles 120 are angularly shaped so that the patient must stretch further to reach each successive handle bar 122. The arm handles 120 are driven by the motor 110 shown in FIG. 4. The shaft 118 carries a small pulley 124 exterior of the pulley wheel 116. A belt 126 passes around the small pulley 124 and a pulley wheel 128 which is mounted on a shaft 130. The shaft 130 is provided with a cam portion which upon rotation reciprocates the crank arm 132 connected to the shaft 130. The opposite end of the crank arm 132 is connected to the lower end of the arm handle 120. The reciprocating action of the crank shaft 132 moves the arm handle 120 toward and away from the patient who is lying on the apparatus 10 in a prone position. This is accomplished by providing an axis of rotation for the arm handles 120 about shafts 134 which are secured to the frame of the apparatus 10 by bearings 136. The arm handles 120 may move either together or opposed to one another. Thus, with leg and arm movement synchronized the patient may experience either homolateral or cross-pattern patterning.

In FIGS. 2, 12 and 13, an alternate embodiment of the arm bar of the invention is identified by the reference numeral 140. The arm bar 140 is supported by a single arm handle 142 which is operatively connected to the crank shaft 132 in the manner previously described. The handle bars 144 of the arm bar 140 are pivotally adjustable about the distal end of the arm handle 142 so that the stretching action imposed on the body of the patient may be maximized. Different heights and arm lengths of patients are more easily accommodated by the adjustable handle bars 144 for maximizing the benefits derived from stretching and lifting the upper torso of the patient.

Referring now to FIG. 18, an extendable arm bar of the invention is identified by the reference numeral 180. The extendable arm bar 180 is supported by the single arm handle 142 as shown. Handle bars 182, 184 and 186 are fixedly secured to the arm handle 142. The ends of the handle bars 182, 184 and 186 are covered by end caps 188. The end caps 188 are secured to the handle bars by set screws or the like. A pivotally adjustable handle bar 190 extends from the handle bar 186. The handle bar 190 may be adjusted to a desired position and locked in that position by set screws or the like. The arm bar 180 may be extended by the addition of a fifth handle bar 192. The handle bar 192 is mounted to the arm bar 180 by removing the end caps 188 and sliding end caps 194 and 196 over the ends of the handle bars 182 and 184 as shown in FIG. 18. The handle bar 192 is captured between the end caps 194, 196. Installation of the additional handle bar 192 is completed by remounting the end caps 188 and securing the end caps 188, 194 and 196 to the handle bars. Two or more additional handle bars may be added to the arm bar assembly 180 in a similar fashion.

Referring now to FIGS. 19 and 20, a leg brace generally identified by the reference numeral 200 is shown mounted to the leg support 22. Some patients do not have complete control of their limbs, particularly their legs. During exercise, such patients are not able to keep their legs properly positioned within the leg supports 22 for receiving the full benefit of the exercise routine.

The leg brace 200 is removably mountable on the leg supports 22 as shown in FIGS. 19 and 20. The leg brace 200 comprises a bracket 202 secured to the leg supports 22 by clamps 204. Two or more clamps 204 are utilized to maintain the leg brace 200 in alignment with the leg supports 22. The lower clamp 206 is adjustable and may be raised or lowered during installation to avoid contacting the hip upholstery.

The bracket 202 includes a U-shaped portion 208. An adjustable slide bracket 210 is mounted on the U-shaped portion 208 of the bracket 202. The slide bracket 210 is raised or lowered along the U-shaped portion 208 for properly positioning the velcro strap 212 so that it may be snugly attached about the leg of the patient. The velcro strap 212 is pivotally mounted to the distal end of a crank 214. The other end of the crank 214 is pivotally connected to the bracket 210. The leg brace crank 214 is formed in the shape of a squared "S" so that the patient's leg is not raised out of the leg support 22 during exercise. It is recommended that during exercise ankle bag weights be attached about the ankles of the patient's legs to insure that the patient's legs do not slip out of the leg supports 22. When in use, the bracket 210 is adjusted so that the velcro strap 212 is secured about the calf of the patient's leg. While a velcro strap 212 is preferred, it is understood that other straps or securing mechanisms are equally suitable.

Referring now to FIGS. 14–17, an alternate embodiment of the apparatus of the disclosure is shown. For some patients it may be beneficial, particularly to the cardiovascular system, to perform the exercises permitted by the apparatus in an elevated position. To this end, the interior frame of the apparatus 10 is pivotally connected to the upper frame member 34. The structure of the apparatus shown in FIGS. 14–17 is substantially similar to the structure previously described and therefore like reference numerals are employed to identify like elements.

Figure 15:
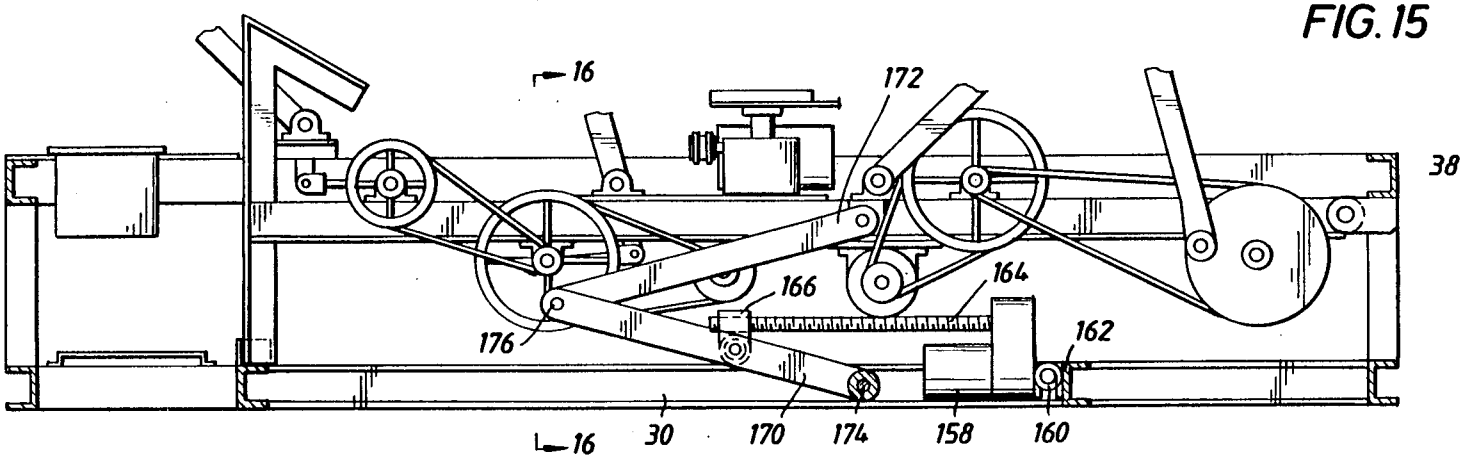
FIG. 15 is a sectional side view of the apparatus taken along line 15—15 of FIG. 14.

Referring first to FIG. 15, it will be observed that the interior frame defined by the channel members 46 is pivotally mounted to the cross member 38 of the upper frame 34. The channel members 46 are connected together by several brace members 150 which have been incorporated to provide additional structural strength to the inner frame defined by the channel members 46. A pair of spaced tabs 152 project inwardly from the cross member 38. The tabs 152 include a hole drilled therethrough for alignment with corresponding holes formed through the ends of the channel members 46 for receiving a pivot pin therethrough. The pivot pin is secured in a conventional manner thereby pivotally connecting the inner frame 148 to the upper frame member 34. The opposite end of the inner frame 148 is supported by the legs 48 which rest on a cross member 156 welded to the lower frame 29. To insure proper alignment, a pair of upstanding angle irons 154 are welded to the cross member 156. In the down or lowered position, the legs 48 of the inner frame 148 are received within the angle brackets 154 to insure that the inner frame 148 does not slip off of the lower frame 29, particularly when it is in use and being vibrated.

The inner frame 148 is raised and lowered by a gear motor 158 which is mounted to the lower frame 29. The gear motor 158 must pivot slightly as the inner frame 148 is raised. The gear motor 158 is therefore welded or otherwise secured to a support bracket which is pivotally mounted at 160 to a brace 162 welded to the lower frame 29. The gear motor 158 may be of the type manufactured by the HammerBlow Corporation. The gear motor 158 is provided with a threaded gear shaft 164 which includes an internally threaded drive nut 166 mounted at the distal end thereof. The drive nut 166 is connected to a cross member 168 which is pivotally connected at opposite ends to lower linkage members 170. The linkage assembly for raising and lowering the inner frame 148 comprises the lower linkage members 170 and upper linkage members 172. The lower linkage members 170 are pivotally connected at 174 to the channel members 30 of the lower frame 29. The linkage members 170 and 172 are pivotally connected to each other at 176. The upper linkage members 172 are likewise pivotally connected to the channel members 46 of the inner frame 148. Actuation of the gear motor 158 rotates the gear shaft 164 causing the drive nut 166 to advance along the gear shaft 164 toward the gear motor 158. As the drive nut 166 advances, the lower linkage members 170 are rotated upwardly about the pivot 174 thereby forcing the upper linkage members 172 to move upwardly until they are fully extended and in line with the lower linkage members 170 as shown in FIG. 17. The gear motor 158 may be turned off at any point so that the inner frame 148 may be inclined at any desired angle between the minimum and maximum angle permitted by linkage members 170 and 172.

In operation, the exercise apparatus of the disclosure provides a complete work out for the entire body and cardiovascular system of the patient. To use the exercise apparatus 10, a patient lies on the unit in a prone position so that the hips of the patient rest snugly on the hip pads 20. The legs of the patient are received in the leg supports 22 and the patient's head rests comfortably on the head rest 16. The exercise apparatus 10 has been previously programmed for the particular exercise sequence for the patient. A typical program may include five exercise phases. The first phase stretches the upper torso of the patient. In the first phase, the patient reaches back and grasps the handle bars 122 so that his body is stretched but not strained. The action of the arm handles 120 reciprocating to and fro lifts the rib cage of the patient, aligns the spine and stimulates the back area of the patient to relax the internal system. The second phase of the exercise program is the stimulation and massaging of the back and shoulders of the patient. In this phase, the shoulder pads 18 pivot up and down to massage and stimulate the upper and lower back. In this position, circulation of the upper body, under arm, mid area and waist of the body is stimulated. Actuation of the hip stimulator 20 stimulates enhanced circulation through the abdominal area, lower hip and inside thigh and upper leg. In the fourth phase, the legs of the patient are moved in a bicycle pedaling-like motion to stimulate the circulation in the thigh, knees and entire leg. The feet of the patient fit within the leg support 22 and slight resistance is applied by the patient to enhance the work out. Additional resistance is provided by raising the frame 148. while the frame 148 is in the raised position. This is particularly beneficial to the circulatory system of bed ridden patients.

While the foregoing is directed to the preferred embodiment of the present invention, other and further embodiments of the invention may be devised without departing from the basic scope thereof, and the scope thereof is determine by the claims which follow.

What is claimed is:

1. A repetitive motion apparatus for exercising the entire body and cardiovascular system of a patient, comprising:

(a) an outer frame, said outer frame including a separable inner frame pivotally mounted at one end of said outer frame;

(b) body support means moveably mounted on said inner frame for moving the limbs of the patient as well as stimulating and massaging the body of the patient;

(c) motor means operatively connected to said body support means;

(d) control means for actuating said motor means to operate said body support means;

(e) means for securing limbs of the patient to said body support means;

(f) arm exercising means pivotally mounted on said inner frame for stretching as well as exercising the arms and torso of the patient;

(g) wherein said inner frame is selectively raised or lowered to a predetermined maximum angle; and (h) leg brace means removably mounted on said inner frame, said leg brace means comprising a bracket having a U-shaped portion for receiving an adjustable slide bracket thereon, said slide bracket supporting a crank member having strap means pivotally mounted at the distal end thereof for securing the legs of a patent.

2. The apparatus of claim 1 wherein said body support means comprise head rest, shoulder stimulator, hip stimulator, and leg stimulator.

3. The apparatus of claim 1 including a remote control panel for operation of one or more exercise apparatus.

4. The apparatus of claim 2 wherein said arm exercising means comprises an adjustable arm bar mounted on said inner frame.

5. The apparatus of claim 1 including actuator means mounted on said outer frame and operatively connected to said inner frame providing a means for raising and lowering said inner frame.

6. The apparatus of claim 1 wherein said arm exercising means includes a removable extension bar selectively mountable on said arm exercising means.

7. The apparatus of claim 2 wherein said head rest is adjustable for raising or lowering the head of a patient.

8. The apparatus of claim 1 including adjustable leg means mounted on said inner frame for supporting and securing the legs of a patient.

9. The apparatus of claim 1 wherein said outer and inner frames defined a substantially box-like frame structure supported on a plurality of casters.

10. A repetitive motion apparatus for exercising the entire body and cardiovascular system of a patent, comprising:

(a) an outer frame, said outer frame including a separable inner frame pivotally mounted at one end of said outer frame, wherein said inner frame is selectively raised or lowered to a predetermined maximum angle;

(b) body support means moveably mounted on said inner frame for moving the limbs of the patient as well as stimulating and massaging the body of the patient;

(c) motor means operatively connected to said body support means;

(d) control means for actuating said motor means to operate said body support means;

(e) arm exercising means pivotally mounted on said frame for stretching as well as exercising the arms and torso of the patient; and (f) leg brace means removably mounted on said inner frame, said leg brace means comprising a bracket having a U-shaped portion for receiving an adjustable slide bracket thereon, said slide bracket supporting a crank member having strap means pivotally mounted at the distal end thereof for securing the legs of a patent.

11. The apparatus of claim 10 including means for securing limbs of the patient to said body support means.

12. The apparatus of claim 10 including actuator means mounted on said outer frame and operatively connected to said inner frame providing a means for raising and lowering said inner frame.

13. The apparatus of claim 10 including adjustable leg means mounted on said inner frame for supporting and securing the legs of a patient.

14. A repetitive motion apparatus for exercising the entire body and cardiovascular system of a patient, comprising:

(a) a frame having body support means mounted thereon;

(b) said body support means being moveably mounted on said frame for moving the limbs of the patient as well as stimulating and massaging the body of the patient;

(c) motor means operatively connected to said body support means;

(d) control means for actuating said motor means to operate said body support means; and (e) leg brace means removably mounted on said frame for securing a leg of the patient to said body support means, wherein said leg brace means comprises a bracket having a U-shaped portion for receiving an adjustable slide bracket thereon, said slide bracket supporting a crank member having strap means pivotally mounted at the distal end thereof for securing the leg of the patient to said body support means.

* * * * *